US009808850B2

(12) United States Patent
Chu et al.

(10) Patent No.: US 9,808,850 B2
(45) Date of Patent: Nov. 7, 2017

(54) PROCESS FOR FORMING HOLLOW MEMBER WITH COMPLICATED CROSS-SECTION

(71) Applicant: HARBIN INSTITUTE OF TECHNOLOGY (WEIHAI), Weihai, Shandong Province (CN)

(72) Inventors: Guannan Chu, Weihai (CN); Yanli Lin, Weihai (CN); Shijian Yuan, Weihai (CN)

(73) Assignee: HARBIN INSTITUTE OF TECHNOLOGY (WEIHAI), Weihai, Shandong Province (CN)

( * ) Notice: Subject to any disclaimer, the term of this patent is extended or adjusted under 35 U.S.C. 154(b) by 0 days.

(21) Appl. No.: 15/340,776

(22) Filed: Nov. 1, 2016

(65) Prior Publication Data

US 2017/0173655 A1 Jun. 22, 2017

(30) Foreign Application Priority Data

Dec. 21, 2015 (CN) ..... 2015 1 0999744

(51) Int. Cl.

| | |
|---|---|
| ***B21D 26/02*** | (2011.01) |
| ***B21D 26/033*** | (2011.01) |
| ***B21D 19/00*** | (2006.01) |
| ***B21D 26/045*** | (2011.01) |
| ***B21D 26/039*** | (2011.01) |
| ***B21D 15/03*** | (2006.01) |
| ***B21D 26/041*** | (2011.01) |

(52) U.S. Cl.

CPC ..... *B21D 26/033* (2013.01); *B21D 15/03* (2013.01); *B21D 19/00* (2013.01); *B21D 26/039* (2013.01); *B21D 26/041* (2013.01); *B21D 26/045* (2013.01)

(58) Field of Classification Search

CPC .... B21D 26/045; B21D 26/033; B21D 19/00; B21D 26/039; B21D 26/043; B21D 15/03; B21D 26/041

USPC ..... 72/58

See application file for complete search history.

(56) References Cited

U.S. PATENT DOCUMENTS

| | | | | |
|---|---|---|---|---|
| RE33,990 E * | 7/1992 | Cudini | B21D 26/033 | 72/360 |
| 5,644,829 A * | 7/1997 | Mason | B21D 26/033 | 29/33 D |
| 5,953,945 A * | 9/1999 | Horton | B21D 26/043 | 72/58 |
| 5,987,950 A * | 11/1999 | Horton | B21D 26/039 | 72/58 |
| 6,266,986 B1 * | 7/2001 | Morita | B21D 26/045 | 72/58 |

(Continued)

*Primary Examiner* — David B Jones

(74) *Attorney, Agent, or Firm* — Birch, Stewart, Kolasch & Birch, LLP

(57) ABSTRACT

A process for forming a hollow member with A complicated cross-section wherein a section of a tube blank first undergoes a bending deformation due to its internal pressure and bend moment generated by the upsetting of an upper die, and is then compressed to be molded under the support of the internal pressure. The process of the invention does not require the reshaping step at an increased pressure. The process can make a hollow member with a complicated cross-section formed under a low pressure, and solves a technical bottleneck relating to a conventional process for forming this kind of members that is subject to an ultrahigh pressure generator.

6 Claims, 2 Drawing Sheets

(56) References Cited

U.S. PATENT DOCUMENTS

| | | | | |
|---|---|---|---|---|
| 6,584,821 | B1 * | 7/2003 | Ghiran | B21D 15/03 29/421.1 |
| 6,739,166 | B1 * | 5/2004 | Shah | B21D 19/00 29/421.1 |
| 7,013,697 | B2 * | 3/2006 | Barber | B21D 26/033 72/306 |
| 7,827,839 | B2 * | 11/2010 | Tomizawa | B21D 26/033 29/421.1 |
| 2008/0121007 | A1 * | 5/2008 | Ingvarsson | B21D 26/045 72/58 |

* cited by examiner

PROCESS FOR FORMING HOLLOW MEMBER WITH COMPLICATED CROSS-SECTION

CROSS-REFERENCE TO RELATED APPLICATIONS

The present application claims priority under 35 USC 119 to Chinese Patent Application No. 201510999744.3 filed Dec. 21, 2015 the entire contents of which are hereby incorporated by reference.

BACKGROUND OF THE INVENTION

1. Field of the Invention

The present invention relates to a forming process, especially to a process for forming a hollow member with a complicated cross-section, associated with a field of industrial manufacture.

2. Description of Background Art

As energy crisis and environmental problem become increasingly prominent, automobile lightening is receiving more and more attention. The hydroforming process is just put forward under this background, and has been widely utilized to form a hollow member with complicated cross-section of a motor vehicle. The hydroforming process is to make a tube blank inside a die expand to be in close contact with the inner surface of the die by applying a very high internal pressure to the inside of the tube blank, and to thereby form a hollow member with a complicated cross-section. However, in practice, this process has the following disadvantages leading to a high production cost: 1) relying heavily on an ultrahigh pressure generator; 2) forming pressure required reaching up to more than one hundred MPa, even up to hundreds of MPa for some members with sharp edges, which would greatly decrease the production efficiency due to the long feedback time of ultrahigh pressure; and 3) requiring a very large equipment due to the high forming pressure.

SUMMARY AND OBJECTS OF THE INVENTION

Based on the above, the present invention is to provide a new forming process, which changes the deformation mode, overcomes over-dependence on ultrahigh pressure, and thus achieves aims of increasing the production efficiency and reducing the cost.

To solve the above-mentioned problems, according to an embodiment of the present invention a new process for forming a hollow member with a complicated cross-section is provided.

According to an embodiment of the present invention, a process for forming a hollow member with a complicated cross-section comprises the steps of:

(1) analyzing cross-sectional perimeters of the member to find the shortest and the longest ones, wherein, the cross-section with the shortest perimeter is designated as a cross-section A and the longest cross-section with the one is designated as a cross-section B;

(2) selecting a tube blank, the cross-sectional perimeter, designated as "L", of which should not be longer than that of the cross-section B of the member;

(3) designing a die C, a die D and two seal punches in accordance with the shape of the member 1, which is the same as the prior art and thus is not described in detail herein;

(4) placing the tube blank into the die D, after which ends of the tube blank are sealed by the seal punches and the inside of the tube blank is filled with a fluid medium;

(5) moving the die C towards the die D such that the die C begins to be in contact with the tube blank;

(6) adjusting internal pressure of the tube blank to p;

(7) continuing moving the die C towards the die D, a bending moment M thereby generated at the tube blank by the combined action of forces from the dies and the internal pressure, wherein, the bending moment M enables cross-sections of the tube blank to undergo bending deformation and be gradually in close contact with inner surfaces of the dies C and D;

(8) adjusting the internal pressure of the tube blank to p2 when the tube blank at the cross-section A is in close contact with 80%-100% of the inner surfaces of the dies C and D; wherein, p2 should be higher than a pressure for suppressing wrinkling required by the forming process, but lower than a pressure for reshaping the tube blank, and calculation methods for the two pressures are the same as the prior art and thus are not described in detail herein;

(9) continuing moving the die C towards the die D until the tube blank at the cross-section B is in close contact with complete inner surfaces of the dies C and D; wherein, during this process, side walls (LL and RR) of the tube blank undergo compressive deformation under the support of the internal pressure p2 of the tube blank at the cross-section A; and the tube blank at the other cross-sections first undergoes bending deformation under the combined action of forces from the dies and the internal pressure and then compressive deformation as lowering the upper die after the tube blank is in contact with 80%-100% of the inner surfaces of the dies;

(10) removing the seal punch to unseal the tube blank;

(11) withdrawing the die C such that the formed member can be removed; and

(12) removing the formed member and then clearing off the fluid medium inside.

According to an embodiment of the present invention, the section of tube blank first undergoes bending deformation due to the internal pressure and bend moment generated by the upsetting of the upper die, and is then compressed to be molded under the support of the internal pressure. The process of the invention does not require an ultrahigh pressure generator to further increase the internal pressure so as to reshape the tube blank, can make a hollow member with complicated cross-section formed under a low pressure, and solves a technical bottleneck that the conventional process for forming this kind of members is subject to an ultrahigh pressure generator. The process is designed reasonably, simple, and has a high production efficiency. The formed member by the process is excellent in properties, shape and precision. Therefore, the process of the present invention has a strong promotional value.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Preferred embodiments of the present invention will be described below in detail with reference to the accompanying drawings. In the figures: 1—member; 2—tube blank; 3—die C; 4—die D; 5—seal bunch.

Figure 1:
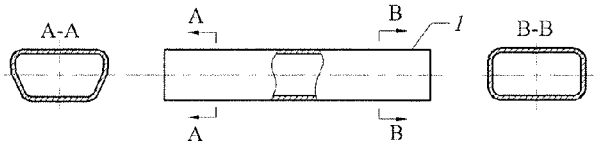
FIG. 1 is a schematic view of the shape of a member.
Figure 2:
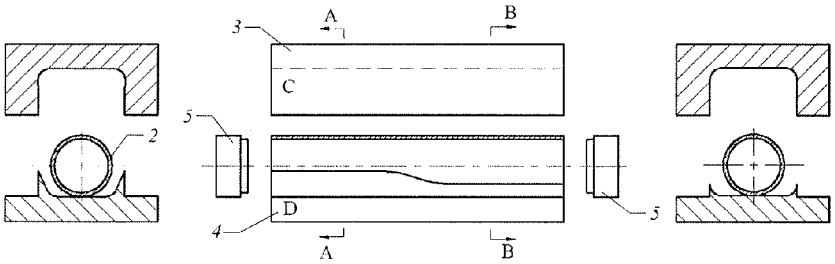
FIG. 2 gives an explanatory view of a step of placing a tube blank into a die D.
Figure 3:
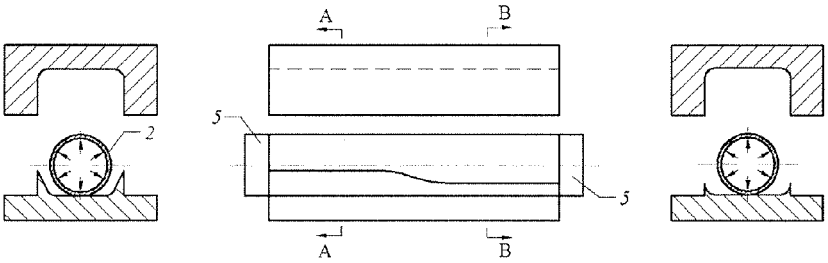
FIG. 3 gives an explanatory view of a step of sealing the tube blank and filling it with a fluid medium.
Figure 4:
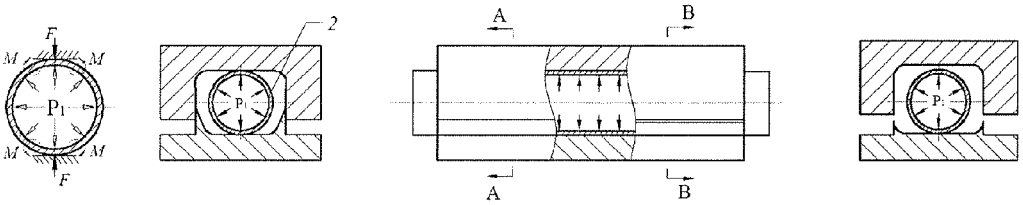
FIG. 4 gives an explanatory view of a step of lowering a die C to be in contact with the tube blank.
Figure 5:
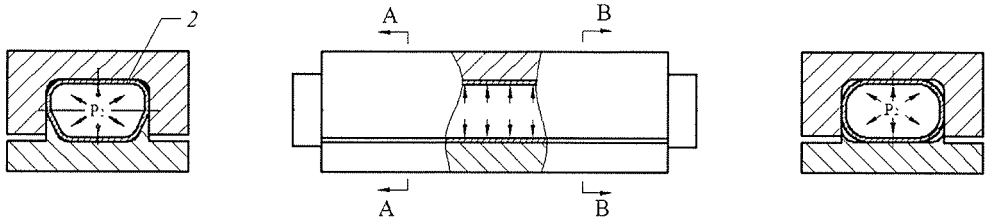
FIG. 5 gives an explanatory view of a step of lowering the die C until the tube blank is in contact with 80%-100% of the inner surfaces of the dies.
Figure 6:
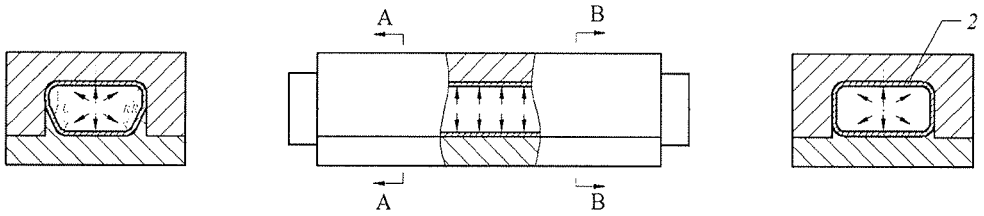
FIG. 6 gives an explanatory view of a step of lowering the die C until the tube blank is in close contact with 100% of the inner surfaces of the dies.

In one embodiment, with reference to FIGS. 1-6, a process for forming a hollow member 1 with complicated cross-section according to the present invention comprises the following steps:

(1) analyzing cross-sectional perimeters of the member 1 to find the shortest and the longest ones, wherein, the cross-section with the shortest perimeter is designated as a cross-section A and the cross-section with the longest one is designated as a cross-section B;

(2) selecting a tube blank 2, the cross-sectional perimeter, designated as "L", of which should not be longer than that of the cross-section B of the member;

(3) designing a die C, a die D and two seal punches 5 in accordance with the shape of the member 1, which is the same as the prior art and thus is not described in detail herein;

(4) placing the tube blank 2 into the die D, after which ends of the tube blank 2 are sealed by the seal punches 5 and the inside of the tube blank 2 is filled with a fluid medium;

(5) moving the die C towards the die D such that the die C begins to be in contact with the tube blank 2;

(6) adjusting internal pressure of the tube blank 2 to p1;

(7) continuing moving the die C towards the die D, a bending moment M thereby generated at the tube blank 2 by the combined action of forces from the dies and the internal pressure, wherein, the bending moment M enables cross-sections of the tube blank 2 to undergo bending deformation and be gradually in close contact with inner surfaces of the dies C and D;

(8) adjusting the internal pressure of the tube blank 2 to p2 when the tube blank 2 at the cross-section A is in close contact with 80%-100% of the inner surfaces of the dies C and D; wherein, p2 should be higher than a pressure for suppressing wrinkling required by the forming process, but lower than a pressure for reshaping the tube blank, and calculation methods for the two pressures are the same as the prior art and thus are not described in detail herein;

(9) continuing moving the die C towards the die D until the tube blank 2 at the cross-section B is in close contact with complete inner surfaces of the dies C and D; wherein, during this process, side walls LL and RR of the tube blank undergo compressive deformation under the support of the internal pressure p2 of the tube blank at the cross-section A; and the tube blank at the other cross-sections first undergoes bending deformation under the combined action of forces from the dies and the internal pressure and then compressive deformation as lowering the upper die after the tube blank is in contact with 80%-100% of the inner surfaces of the dies;

(10) removing the seal punch 5 to unseal the tube blank 2;

(11) withdrawing the die C such that the formed member can be removed; and

(12) removing the formed member and then clearing off the fluid medium inside.

In one embodiment, the fluid medium in step (4) is a liquid or a gas.

In one embodiment, p1 in step (6) is 0.1-10 MPa, and p2 in step (8) is 0.5-100 MPa.

In one embodiment, the tube blank in step (2) is made of metal.

In one embodiment, the tube blank in step (2) is made of aluminum alloy, mild steel, high-strength steel, magnesium alloy, hard alloy or high-temperature alloy.

The present invention can achieve the following technical effects: 1) the process of the invention does not require the reshaping step at an increased pressure, can make the member formed while closing the die and thereby has a high production efficiency;

2) the liquid pressure required by the upsetting forming process is lower than that of the hydroforming process, the process of the present invention thereby getting rid of dependence on the ultrahigh pressure generator; and 3) when molded by upsetting, the tube blank undergoes bending and compressive deformations. Under this deformation mode, members with uniform wall thickness and compact texture can be obtained, and even low plasticity materials can also form the members with complicated cross-section.

The above described is merely preferred embodiments of the present invention, and not exemplified to intend to limit the present invention. Any modifications and changes without departing from the scope of the spirit of the present invention are deemed as within the scope of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for forming a hollow member, the process comprising the following steps:

(1) analyzing cross-sectional perimeters of the hollow member to find a shortest cross-sectional perimeters and a longest cross-sectional perimeters, wherein, the shortest cross-sectional perimeters is designated as a cross-section A and the longest cross-sectional perimeters is designated as a cross-section B;

(2) selecting a tube blank, having a cross-sectional perimeter designated as "L", said cross-sectional perimeter "L" is not longer than the cross-section B of the hollow member;

(3) selecting a die C, a die D, and two seal punches in accordance with a shape of the hollow member, the die C and the die D having inner surfaces;

(4) placing the tube blank into the die D, and sealing ends of the tube blank by the seal punches and filling an inside of the tube blank with a fluid medium;

(5) moving the die C towards the die D such that the die C begins to be in contact with the tube blank in step (4);

(6) adjusting internal pressure of the tube blank in step (5) to p1, p1 is 0.1-10 MPa;

(7) continuing moving the die C towards the die D, a bending moment M thereby generated at the tube blank in step (6) by a combined action of forces from the dies and the internal pressure of the tube blank, wherein, the bending moment M makes the cross-sections of the tube blank to undergo bending deformation and be gradually in close contact with inner surfaces of the dies C and D;

(8) adjusting the internal pressure of the tube blank in step (7) to p2 when the tube blank at the cross-section A is in close contact with 80%-100% of the inner surfaces of the dies C and D; wherein, p2 is 0.5-100 MPa;

(9) continuing moving the die C towards the die D until the tube blank in step (8) at the cross-section B is in close contact completely with the inner surfaces of the dies C and D; wherein, during this process, side walls of the tube blank undergo compressive deformation under a support of the internal pressure p2 of the tube blank at the cross-section A; and the tube blank at other cross-sections first undergoes bending deformation under the combined action of forces from the dies and the internal pressure and then compressive deformation as lowering the upper die after the tube blank is in contact with 80%-100% of the inner surfaces of the dies;

(10) removing the seal punch to unseal the tube blank;

(11) withdrawing the die C such that the formed member can be removed; and

(12) removing the formed member and then clearing off the fluid medium inside.

2. A process according to claim 1, wherein the fluid medium in step (4) is a liquid or a gas.

3. A process according to claim 1, wherein the tube blank in step (2) is made of metal.

4. A process for forming a hollow member, the process comprising the following steps:

(1) analyzing cross-sectional perimeters of the hollow member to find a shortest cross-sectional perimeters and a longest cross-sectional perimeters, wherein, the shortest cross-sectional perimeters is designated as a cross-section A and the longest cross-sectional perimeters is designated as a cross-section B;

(2) selecting a tube blank, having a cross-sectional perimeter designated as "L," said cross-sectional perimeter "L" is not longer than the cross-section B of the hollow member;

(3) selecting a die C, a die D, and two seal punches in accordance with a shape of the hollow member, the die C and the die D having inner surfaces;

(4) placing the tube blank into the die D, and sealing ends of the tube blank by the seal punches and filling an inside of the tube blank with a fluid medium;

(5) moving the die C towards the die D such that the die C begins to be in contact with the tube blank in step (4);

(6) adjusting internal pressure of the tube blank in step (5) to p1;

(7) continuing moving the die C towards the die D, a bending moment M thereby generated at the tube blank in step (6) by a combined action of forces from the dies and the internal pressure of the tube blank, wherein, the bending moment M makes the cross-sections of the tube blank to undergo bending deformation and be gradually in close contact with inner surfaces of the dies C and D;

(8) adjusting the internal pressure of the tube blank in step (7) to p2 when the tube blank at the cross-section A is in close contact with 80%-100% of the inner surfaces of the dies C and D;

(9) continuing moving the die C towards the die D until the tube blank in step (8) at the cross-section B is in close contact completely with the inner surfaces of the dies C and D;

wherein, during this process, side walls of the tube blank undergo compressive deformation under a support of the internal pressure p2 of the tube blank at the cross-section A; and the tube blank at other cross-sections first undergoes bending deformation under the combined action of forces from the dies and the internal pressure and then compressive deformation as lowering the upper die after the tube blank is in contact with 80%-100% of the inner surfaces of the dies;

(10) removing the seal punch to unseal the tube blank;

(11) withdrawing the die C such that the formed member can be removed; and

(12) removing the formed member and then clearing off the fluid medium inside.

5. A process according to claim 4, wherein the fluid medium in step (4) is a liquid or a gas.

6. A process according to claim 4, wherein the tube blank in step (2) is made of metal.

* * * * *